United States Patent [19]

Tani formerly Nishikawa et al.

[11] 4,159,172

[45] Jun. 26, 1979

[54] TRANSFER SHEET SEPARATOR FOR USE WITH ELECTROPHOTOGRAPHIC COPYING MACHINE

[75] Inventors: Tatsuo Tani formerly Nishikawa, Tokyo; Toyoo Okamoto, Yokohama, both of Japan

[73] Assignee: Ricoh Company, Ltd., Japan

[21] Appl. No.: 814,037

[22] Filed: Jul. 8, 1977

Related U.S. Application Data

[63] Continuation of Ser. No. 626,272, Oct. 28, 1975, abandoned.

[30] Foreign Application Priority Data

Oct. 26, 1974 [JP] Japan ..... 49/123661

[51] Int. Cl.[2] ..... G03G 15/00

[52] U.S. Cl. ..... 355/3 TR; 96/1.4; 271/DIG. 2

[58] Field of Search ..... 355/3 R, 3 TE, 3 TR, 355/3 DR; 271/DIG. 2; 96/1.4

[56] References Cited

U.S. PATENT DOCUMENTS

| | | | |
|---|---|---|---|
| 3,508,824 | 4/1970 | Leinbach et al. | 355/3 R |
| 3,620,615 | 11/1971 | Volkers | 355/3 R |
| 3,626,260 | 12/1971 | Kimura et al. | 355/3 R |
| 3,684,363 | 8/1972 | Ito et al. | 355/3 R |
| 3,770,345 | 11/1973 | Kawakubo et al. | 355/3 DD |
| 3,817,615 | 6/1974 | Adachi et al. | 355/3 R |

*Primary Examiner*—R. L. Moses

*Attorney, Agent, or Firm*—McGlew and Tuttle

[57] ABSTRACT

A transfer sheet separator for use with electrophotographic copying machines in which either a toner image or an electrostatic latent image on a photoreceptor drum is transferred to a transfer sheet. A separation roller is arranged near to the drum surface at a separation station for separating the image transferred sheet which inevitably carries residual charge from the drum by electrostatic attraction. To this end, the roller is made from conductive material and either connected to the ground so as to be able to carry the opposite polarity charge than said charge by induction or floated and applied a bias potential of the opposite polarity. Alternatively, the roller is made of dielectric material and charged as well through a rubbing action, for example. With this electrostatic separation means, mechanical means cooperates for practical purposes to ensure such operation.

7 Claims, 3 Drawing Figures

TRANSFER SHEET SEPARATOR FOR USE WITH ELECTROPHOTOGRAPHIC COPYING MACHINE

This is a continuation of application Ser. No. 626,272 filed Oct. 28, 1975 now abandoned.

BACKGROUND OF THE INVENTION

The invention relates to a transfer sheet separator for use with an electrophotographic copying machine.

FIG. 1 shows a conventional sheet separator as used in an electrophotographic copying machine. In this Figure, a drum 2 rotating in the direction indicated by an arrow 1 is peripherally provided with a photoconductive, photosensitive member, and an electrostatic latent image is formed thereon by the known electrophotographic process. The latent image is developed by either dry or wet developing process to provide a toner image. A transfer sheet 3 is fed in the direction indicated by an arrow 4 and urged by a charger 5 into abutting engagement against the peripheral surface of the drum 4, whereby the toner image on the periphery of the drum is transferred onto the sheet 3. During the abutting engagement between the sheet and the drum, one lateral edge of the sheet 3 rides on a separation member 6, which separates this lateral edge of the sheet 3 away from the drum surface as the sheet 3 moves forward.

The separation member 6 extends around the drum periphery and also around the periphery of a turn roller 7, and has its opposite ends held by holding means, not shown. The separation member 6 is tensioned so as to be in abutting engagement with the peripheral surface of both the drum 2 and the turn roller 7. The turn roller 7 is fixedly mounted on a shaft 9 which is rotatably mounted on stationary members, and is normally maintained in rotation in the direction indicated by an arrow 8. A plurality of guide rollers 11 are also fixedly mounted on the shaft 9, and rotate in the direction of the arrow 8 together with the turn roller 7.

As one lateral edge of the sheet 3 moves along the separation member 6 into the space between it and the turn roller 7, the sheet 3 will be separated from the drum surface as indicated at 3A. The sheet 3 is held by the turn roller 7 only at its one lateral edge, so that the resilience of the sheet material causes the radius of curvature in the sheet 3 to be increased gradually as further axially removed from the turn roller 7. Consequently, the image carrying surface of the sheet 3 may move into abutment against an upper shield plate 12 or some other stationary member located in the vicinity thereof, causing a jamming or a rubbing of the image. Such effect is considerably pronounced under low humidity condition when the transfer sheet bears an increased amount of electrostatic charge and hence is strongly attracted toward such stationary members. This disadvantage can be eliminated by blowing an air stream, as indicated by an arrow 13, against the sheet 3 on its image carrying side so as to urge the rear surface of the sheet 3 against the guide rollers, or by withdrawing air from the rear surface of the sheet to produce a negative pressure there, again causing the sheet 3 to bear against the peripheral surface of the guide rollers 11. In these instances, one or more fans must be provided, which require the provision of a special space, interfering with the design of a compact copying machine. With a copying machine of wet developing type, the quantity of air stream which is either supplied or withdrawn accelerates the evaporation of the solvent from the drum surface and a developing tank, preventing an efficient use of the solvent. Additionally, the quantity of evaporated solvent may cause a contamination of internal components. With a copying machine of dry developing type, the air stream may disturb the unfixed image on the sheet 3 or may cause a dispersion of a toner powder which is disengaged from the drum surface of the sheet 3 into the space of the machine, thus presenting an additional space requirement to result in an increased cost.

SUMMARY OF THE INVENTION

It is an object of the invention to provide a transfer sheet separator for use with an electrophotographic copying machine which eliminates the above-mentioned disadvantages.

DETAILED DESCRIPTION OF EMBODIMENT

Figure 1:
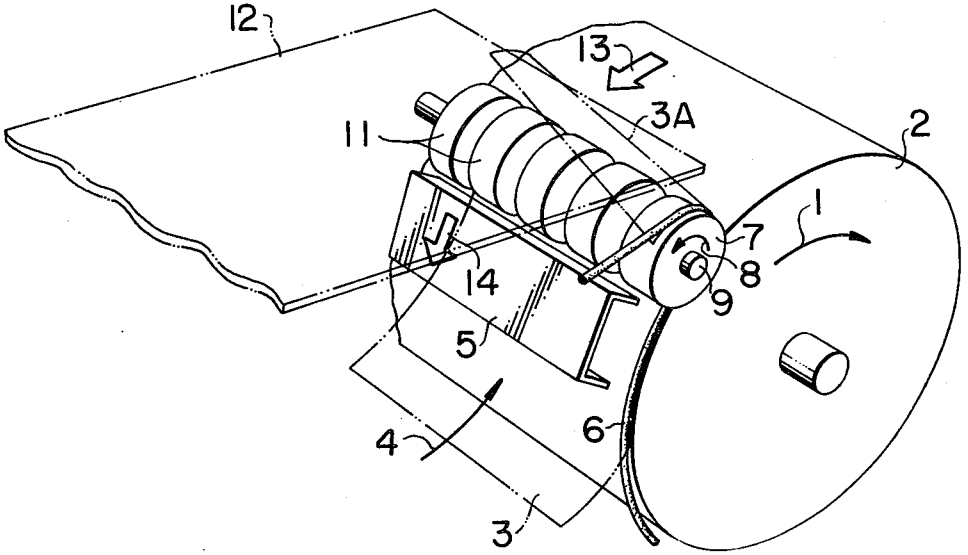
FIG. 1 (PRIOR ART)
FIG. 1 is a perspective view of a conventional separator.
Figure 2:
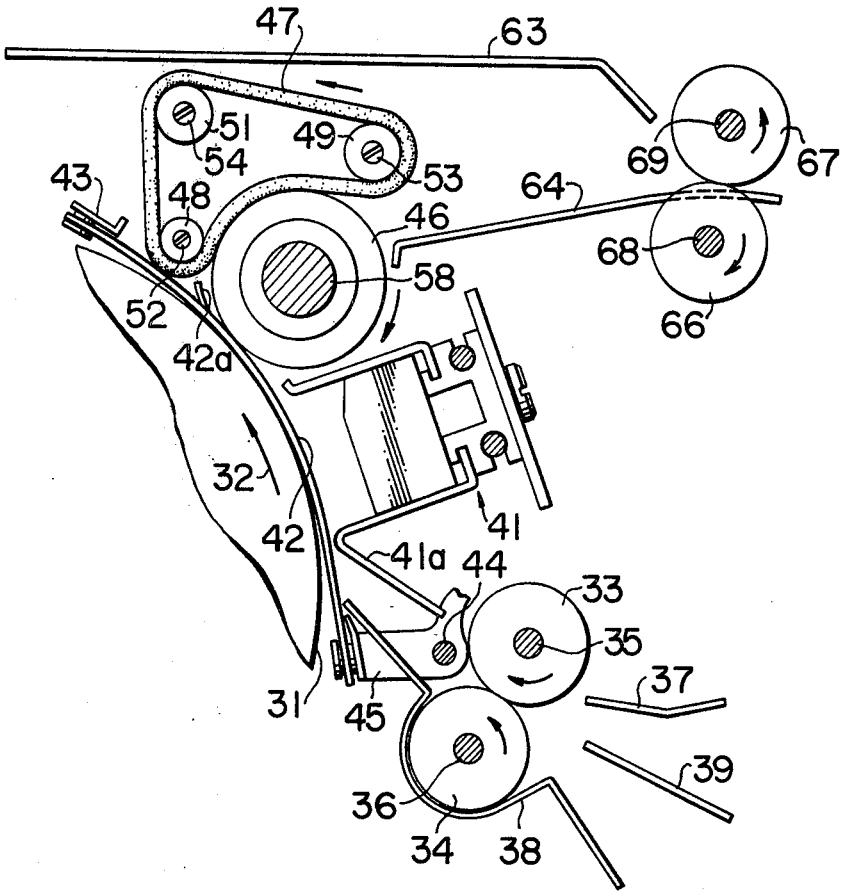
FIG. 2 is a front view of the sheet separator constructed in accordance with one embodiment of the invention.

Referring to FIG. 2, there is shown a drum 31 which is maintained rotating in the direction indicated by an arrow 32. It is assumed that the drum 31 carries a toner image, not shown, which can otherwise be an electrostatic latent image on its peripheral surface. Thus, these images will be referred to as an intermediate image hereinafter. A pair of feed rollers 33, 34 have their shafts 35 and 36 rotatably mounted on stationary parts, and rotate in respective directions indicated by arrows while maintaining a mating relationship between them. A pair of guide plates 37 and 38 are located adjacent to the feed rollers for guiding a transfer sheet 39, which is fed by the feed rollers toward the drum surface. The path of movement of the sheet 39 between the feed rollers and the drum surface is also guided by the guide plate 38 and another guide plate 41*a* which forms a part of a charger 41. When the sheet 39 is juxtaposed with the drum surface, the charger 41 which is located in parallel relationship with the drum 31 transfers the toner image onto the sheet. A separation member 42 comprising a leaf spring, for example, extends around part of the periphery of the drum adjacent to its one axial end, which is located below the plane of the drawing, as viewed in FIG. 2, and has its upper end detachably attached to a stationary member 43 while its lower end is detachably attached to the free end of a release lever 45 which is pivotally mounted at 44 on a stationary member. The separation member 42 is formed with a riser 42*a* which directs one lateral edge of the sheet 39 into the space between a turn roller 46 and an endless belt 47 which is maintained in engagement therewith. It should be understood that the separation member may comprise a separation pawl of a known construction.

Figure 3:
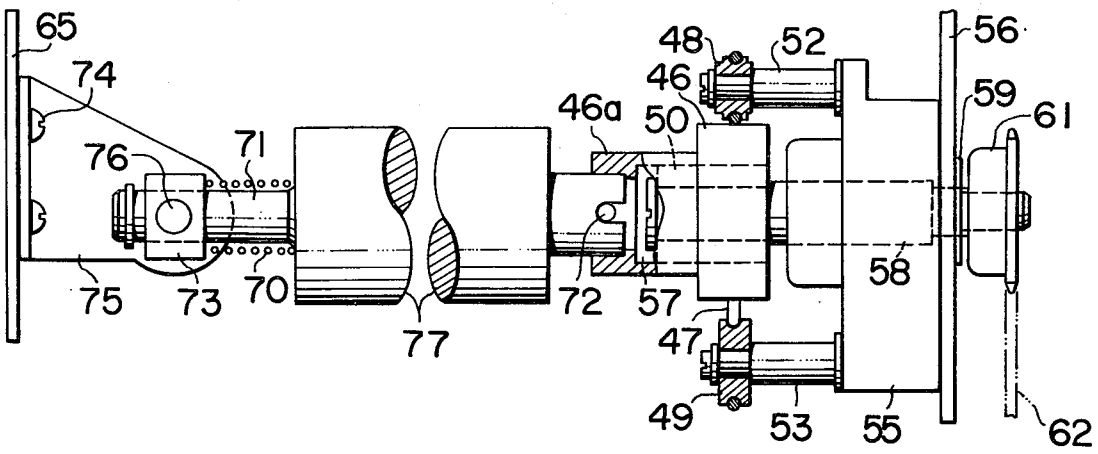
FIG. 3 is a top plan view of the apparatus shown in FIG. 2.

The belt 47 extends around guide rollers 48, 49, 51 which are pivotally mounted on studs 52, 53, 54, respectively, which are in turn fixedly mounted on a support member 55. As shown in FIG. 3, the support member 55 is secured to one sideplate 56 of the copying machine. Referring to FIG. 3, the turn roller 46 is rotatably mounted by a screw 57, on one end of a shaft 58, the other end of which extends through the support member 55 and through a bearing 59 fixedly mounted in the sideplate 56 and is fixedly connected with a sprocket 61. The drive from the shaft 58 is transmitted to the turn roller through a roller clutch 50, which is disconnected during a jamming of the transfer sheet. Referring to FIG. 2, an upper shield plate 63 and a guide plate 64 are secured to the sideplate 56 and the opposite sideplate 65 (see FIG. 3), and a pair of delivery rollers 66, 67 are mounted on shafts 68, 69 which are located adjacent to the end of the shield plate and the guide plate 64. These delivery rollers rotate in the directions indicated by arrows while maintaining a mating relationship therebetween. A chain 62 extends around the sprocket 61 and also around another sprocket, not shown, which is fixedly mounted on one end of the shaft 68 associated with the delivery roller 66, for transmitting the rotation of the shaft 58 to the delivery rollers 66 and 67. The shaft 58 fixedly carries a gear, not shown, which is located within the support member 55 and which meshes with a drive gear, not shown, which is integral with the drum 31, thus imparting the rotary drive therefrom.

Referring to FIG. 3, the turn roller 46 has a boss 46*a* into which one end of a shaft 71 is fitted, the shaft 71 being formed with a notch which is engaged by a pin 72 fixedly mounted on the boss 46*a*. The other end of the shaft 71 is slidably and rotatably mounted in a bearing 73 which is in turn pivotally mounted at 76 on a support plate 75 secured to the sideplate 65 by means of set screws 74. A spring 70 is disposed on the shaft 71 to urge the shaft 71 to the right as viewed in FIG. 3. A guide roller 77 is fixedly mounted on or may be formed in one piece with the shaft 71, and is formed of an electrically conductive material, for example, so as to be susceptible to the influence of an electrostatic attraction. During operation of the copier, the guide roller and turn roller act as a unit and the turn roller can be considered to be a portion of the guide roller.

Referring to FIG. 2, when the turn roller 46 and the belt 47 run in the respective directions indicated by the arrows, one lateral edge of the sheet 39 which is separated from the drum surface by the separation member 42 will be directed into the nip between the belt and the turn roller to be conveyed away from the drum surface. Since the sheet 39 maintains an amount of electrostatic charge subsequent to the completion of a transfer operation, the rear surface of the sheet 39 which is remote from the turn roller 46 will be attracted by the conductive guide roller 77 into abutting engagement with the pripheral surface thereof during its movement onto the guide plate 64. In this manner, contact of the image carrying surface of the sheet 39 with the upper shield plate 63 or any other adjacent stationary member is avoided, thus preventing a jamming or a disturbance to the image.

The attraction of the sheet 39 against the guide roller 77 can be improved by applying an electric potential to the guide roller 77 which is of the opposite polarity of the charge on the sheet 39. An electric potential can be applied to the guide roller 77 by electrically isolating the conductive guide roller 77 from the ground or by using a guide roller formed of a dielectric material and charging it with a charger or through a rubbing action with a suitable member. While in the embodiment described above, the invention has been described as applied to a drum-shaped photosensitive member, it should be understood that the invention is equally applicable to a belt-shaped photosensitive member or to the direct formation of an electrostatic image on a recording member. Also, the invention is not limited to the transfer of a toner image, but may be applied to the transfer of an electrostatic image.

To summarize, the invention avoids a jamming or a disturbance to the image by providing a guide roller which attracts the rear surface of a transfer sheet immediately after its separation from the drum surface, thereby avoiding any contact of the image carrying surface of the sheet with the upper shield plate or any other member.

What is claimed is:

1. A transfer sheet separator for use with an electrophotographic copying machine, comprising, in combination:

(a) a photo receptor movable successively past first and second localities in sequence while retaining an intermediate image on a surface thereof;

(b) an elongated, narrow, stationary transverse sheet-engaging member extending along only one lateral edge of such surface of said photoreceptor throughout said first and second locations;

(c) means operable to feed a transfer sheet onto such surface of said photoreceptor at such first locality to move, along with said photoreceptor, with one lateral edge of the transfer sheet positioned above said elongated, narrow engaging member;

(d) means at such first locality operable to transfer the intermediate image from such surface of said photoreceptor onto a facing surface of the transfer sheet and thus to charge the transfer sheet to an electrostatic potential of a first polarity;

(e) a riser on said engaging member at such second locality operable to deflect the transfer sheet outwardly away from said narrow engaging member and said photoreceptor surface;

(f) a rotatable guide roller having a turn roller portion at such second locality, separate from said engaging member and having its axis extending parallel to and transversely of such surface of said photoreceptor, for engaging the opposite rear surface of the charged transfer sheet following turning away of the transfer sheet from said narrow engaging member;

(g) an endless belt having a portion thereof aligned with said narrow engaging member and trained over said turn roller portion to nip the turned-away transfer sheet between said turn roller portion and said belt;

(h) delivery means operable to receive the charged transfer sheet from between said turn roller portion and said belt;

(i) stationary metal framework means adjacent said delivery means facing the image carrying surface of the transfer sheet and to which the transfer sheet is attracted due to its charge; and (j) means maintaining, on at least a portion of the peripheral surface of said guide roller adjacent said surface of said photoreceptor, an electrostatic charge of a polarity opposite to that of the transfer sheet, whereby said rear surface of the transfer sheet is maintained in engagement with said guide roller so that the image-carrying facing surface of the transfer sheet is not attracted into engagement with said stationary framework means.

2. A transfer sheet separator according to claim 1, wherein said guide roller comprises conductive material and is isolated from ground.

3. A transfer sheet separator according to claim 1, wherein said guide roller comprises conductive material and is isolated from ground; said charge maintaining means comprising means applying a bias potential to said turn roller.

4. A transfer sheet separator according to claim 1, wherein said guide roller comprises dielectric material and said potential maintaining means comprises means charging the peripheral surface of the roller.

5. A transfer sheet separator according to claim 4, wherein said charging means comprises means rubbing the peripheral surface of the guide roller.

6. A transfer sheet separator according to claim 4, wherein said charging means comprises a corona discharger.

7. A method of separating a transfer sheet from a movable photoreceptor of an electrophotographic copying machine having a feed station for feeding the transfer sheet to a portion of the movable photoreceptor, a charger comparable to transfer an intermediate image from the photoreceptor to a facing surface of the transfer sheet and, thus, to charge the transfer sheet to an electrostatic potential of a first polarity, comprising, providing a narrow elongated stationary transfer sheet-engaging member along only one lateral edge of the surface of the photoreceptor, feeding the transfer sheet to the surface of the photoreceptor with one lateral edge thereof positioned over the elongated narrow stationary engaging member, providing a riser extending outwardly of the photoreceptor on the narrow engaging member for lifting the lateral edge of the transfer sheet away from the photoreceptor, providing a rotatable guide roller having a turn roller portion aligned with the narrow engaging member, the guide roller being separate from the engaging member and having its axis extending parallel to and transversely of the surface of the photoreceptor for engaging the opposite rear surface of the charge transfer sheet following the turning away of the transfer sheet by the riser from the photoreceptor, providing an endless belt having a portion aligned with the narrow engaging member and the turn roller portion of the guide roller and entrained over the turn roller portion to nip the turned away transfer sheet between the turn roller portion and the belt, providing delivery means operable to receive the charge transfer sheet from between the turn roller portion and the belt, providing a stationary metal frame adjacent the delivery means facing the image carrying surface of the transfer sheet to which the transfer sheet is attached due to its charge, and providing an electrostatic charge to the surface of the guide roller of a polarity opposite to that of the transfer sheet and of sufficient strength to retain the transfer sheet against the guide roller, whereby the rear surface of the transfer sheet is maintained in engagement with the guide roller so that the image-carrying facing surface of the transfer sheet is not attracted into engagement with the stationary metal framework.

* * * * *